United States Patent [19]

Morgan

[11] 4,195,758

[45] Apr. 1, 1980

[54] APPARATUS FOR SEPARATING SNAPSTRATES INTO INDIVIDUAL HYBRID SUBSTRATES

[75] Inventor: John H. Morgan, Alburquerque, N. Mex.

[73] Assignee: GTE Automatic Electric Laboratories, Incorporated, Northlake, Ill.

[21] Appl. No.: 892,604

[22] Filed: Apr. 3, 1978

[51] Int. Cl.[2] ..... B26F 3/00

[52] U.S. Cl. ..... 225/98; 225/3; 225/4

[58] Field of Search ..... 225/98, 99, 2–5, 225/96.5, 103

[56] References Cited

U.S. PATENT DOCUMENTS

| | | | |
|---|---|---|---|
| 1,765,990 | 6/1930 | Melville et al. | 225/98 |
| 2,053,375 | 9/1936 | Nicholas | 225/3 |
| 2,180,837 | 11/1939 | Rudolph | 225/98 |
| 2,555,916 | 6/1951 | Clark | 225/98 |
| 3,175,745 | 3/1965 | Insolio | 225/2 X |
| 3,268,135 | 8/1966 | Smith | 225/2 |
| 3,494,523 | 2/1970 | Kalvelage | 225/98 |
| 3,717,292 | 2/1973 | Honeycutt et al. | 225/99 |

*Primary Examiner*—Frank T. Yost

*Attorney, Agent, or Firm*—Russell A. Cannon

[57] ABSTRACT

Rectangularly shaped snapstrates are separated into substrates along kerfs that are parallel to edges thereof by belt and roller flexure forces produced by two belts that are caused to be contiguous over the suspended length of the upper belt by a pressure roller forcing the two belts together at an intermediate point between roller supports for the belts. This produces oppositely facing curvatures in the belts at spaced apart transverse lines thereon which flex snapstrates in opposite directions with a flexure force which is sufficient to separate snapstrates on the lower belt with kerfs facing in the right direction and which is not sufficient to separate snapstrates there with kerfs facing in the wrong direction. In an alternate embodiment, the peripheries of rollers are tapered in vertical sections for separating snapstrates along kerfs oriented at right angles. In a further embodiment, only a single belt with a pressure roller pressing down on it is employed to separate snapstrates.

8 Claims, 8 Drawing Figures

APPARATUS FOR SEPARATING SNAPSTRATES INTO INDIVIDUAL HYBRID SUBSTRATES

BACKGROUND OF INVENTION

This invention relates to hybrid circuit manufacturing techniques, and more particularly to improved apparatus for separating snapstrates into individual hybrid substrates.

A hybrid circuit generally comprises a rectangularly shaped ceramic substrate having patterns of resistive and electrically conductive inks screened and fired on one side thereof, with other circuit elements and leads later being connected to selected points of the patterns. In order to produce as many inked substrates as possible from a single screen with a minimum of time and expense, the current practice is to simultaneously ink a number of different substrates which are connected together along edges thereof. Such an array of connected substrates is called a snapstrate which is essentially a thin rectangularly shaped ceramic member that is divided into a matrix of individual substrates by scribing or scoring at least one side thereof (see FIGS. 1–5). The scribing produces kerfs which extend all the way across the ceramic member. A kerf is a line, groove, scratch, slit or notch formed in the broad surface of a ceramic member, for example, by scribing. It may also be produced by other methods such as with a laser beam or stamping the ceramic member when it is in its green state. The dielectric-ceramic member of a snapstrate has the property of being brittle and fracturable in that when it is flexed sufficiently, then it will fracture or break and separate into at least two different separate parts. When a snapstrate is flexed correctly, it will fracture cleanly along a kerf. For all practical purposes, the kerfs are invisible to the naked eye. After a snapstrate is inked and fired, it must be divided into substrates. Although the patterns are readily formed on snapstrates with respect to kerfs and edges thereof, it may not be visually obvious whether kerfs are on the top or bottom of inked snapstrates. One prior-art method of separating inked and fired snapstrates into substrates is for an individual to manually flex the snapstrate in one direction and then in the opposite direction in an attempt to fracture it along a kerf. Another method is to locate a snapstrate in a shallow trough while it is flexed manually. These methods are time consuming and expensive in that they may result in the improper breakage and destruction of a large number of snapstrates when they separate along a line other than a kerf.

An object of this invention is the provision of improved apparatus for automatically separating snapstrates into substrates.

SUMMARY OF INVENTION

In accordance with this invention, apparatus for separating a snapstrate into substrates, where the snapstrate is a matrix of thick film dielectric substrates formed on a common dielectric member that is divided into adjacent substrates by at least one kerf, comprising: a first endless belt; first means supporting said first belt for rotation with a first selected amount of tension in it; second means causing rotation of said first belt; and a first roller supported above said first belt for rotation about its axis which is generally perpendicular to the direction of rotation of said first belt; said first roller having a diameter and a portion of the circumference thereof making a pressure contact with the top of said first belt along a line for flexing a snapstrate moving on said first belt.

DESCRIPTION OF DRAWINGS

This invention will be more fully understood from the following detailed description of preferred embodiments thereof taken with respect to the drawings, in which.

DESCRIPTION OF PREFERRED EMBODIMENTS

Figure 2:
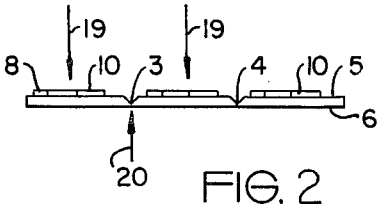
FIGS. 1 and 2 are plan and front elevation views, respectively, of an upright snapstrate which is divided into three substrates 1A, 1B and 1C that are joined together along kerfs 3 and 4.
Figure 4:
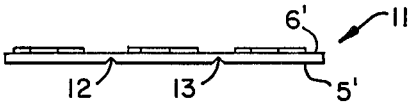
FIGS. 3 and 4 are plan and elevation view of an inverted snapstrate 11.
Figure 1:
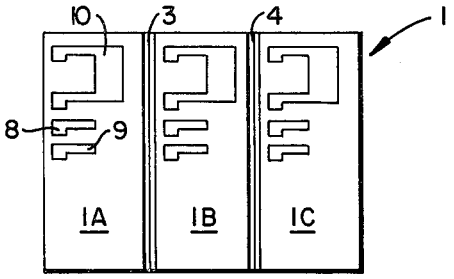
Figure 3:
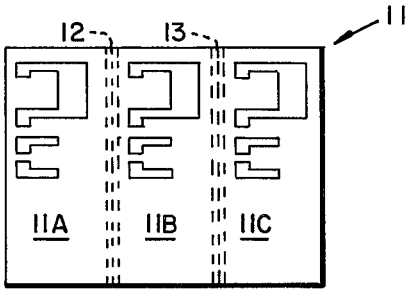

Referring now to FIGS. 1 and 2, a snapstrate 1 comprises a ceramic member which is divided into three substrates 1A, 1B and 1C by kerfs 3 and 4 on the top surface 5 thereof. The top surface of a ceramic member is defined here as the one having kerfs on it. The kerfs 3 and 4 are parallel to each other and edges of the snapstrate 1 which typically measures 2 inches×3 inches×0.025 inch, each of the individual substrates here being 1 inch wide. The kerfs 3 and 4 are believed to be approximately 0.001 inch wide and 0.001 inch deep such that they are essentially invisible to the naked eye. Although the location and direction of kerfs on snapstrate 1 are known from its shape, it is difficult to readily determine which of the top and bottom surfaces 5 and 6 thereof contain the kerfs once the snapstrate has been handled in processing such as a cleaning operation. The snapstrate 1 has conductive lands 8, conductive leads 9, and resistors 10 inked on the same surface 5 as the kerfs there. The snapstrate 11 in FIGS. 3 and 4 is the smae as snapstrate 1 except that patterns are inked on the surface 6' which does not have kerfs on it. It is desirable to separate inked and fired snapstrates in FIGS. 1–4 along kerfs there (without breaking and destroying individual substrates) for subsequent use, and/or so that discrete electrical components and leads may be attached to various points of the circuit patterns at a later time.

Figure 5:
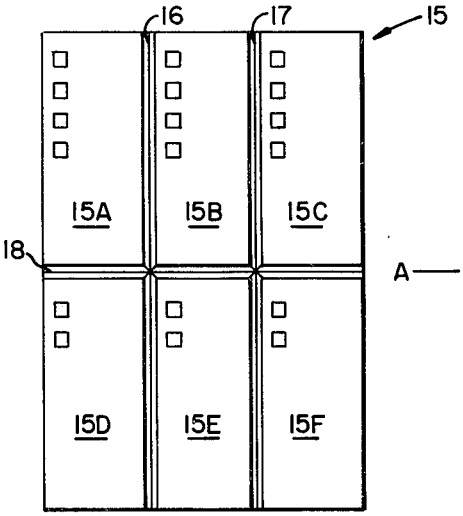
FIG. 5 is a plan view of a snapstrate 15 comprising three pairs of substrates which are joined together along kerfs 16, 17 and 18.

The snapstrate 15 in FIG. 5 is divided into six different substrates 15A–15F, inclusive, by kerfs 16 and 17 which are perpendicular to a third kerf 18, all of which are on the top surface there which also has patterns on it. Each substrate of snapstrate 15 is connected to other ones of the substrates there along at least two adjacent edges which are perpendicular to each other. By way of example, the substrate 15A is connected to substrates 15B and 15D along kerfs 16 and 18, respectively.

It has been discovered that it requires more flexure force to break a snapstrate 1 incorrectly than it does to fracture it along a kerf. More specifically, when a snapstrate 1 is flexed about kerf 3 by sufficient forces in the direction of arrows 19 and 20 in FIG. 2, it will readily fracture and separate along this kerf 3. If sufficient forces are exerted in the opposite directions, however, it is probable that the snapstrate 1 will fracture along some line other than kerf 3. Stated differently, if snapstrate 1 is flexed sufficiently in the wrong direction, then it will fracture incorrectly and be destroyed. Thus, it is only necessary to flex a snapstrate 1 or 11 in one direction to separate it into individual substrates. A snapstrate 15 must be flexed in two different directions, however, to separate it into the six substrates shown there. In accordance with this invention, apparatus is provided which automatically applies a controlled flexure force to a snapstrate 1 which is determined to be sufficient to fracture it along a kerf when it is flexed in the right direction, but which is less than that required to break it when it is flexed in the wrong direction.

Figure 6:
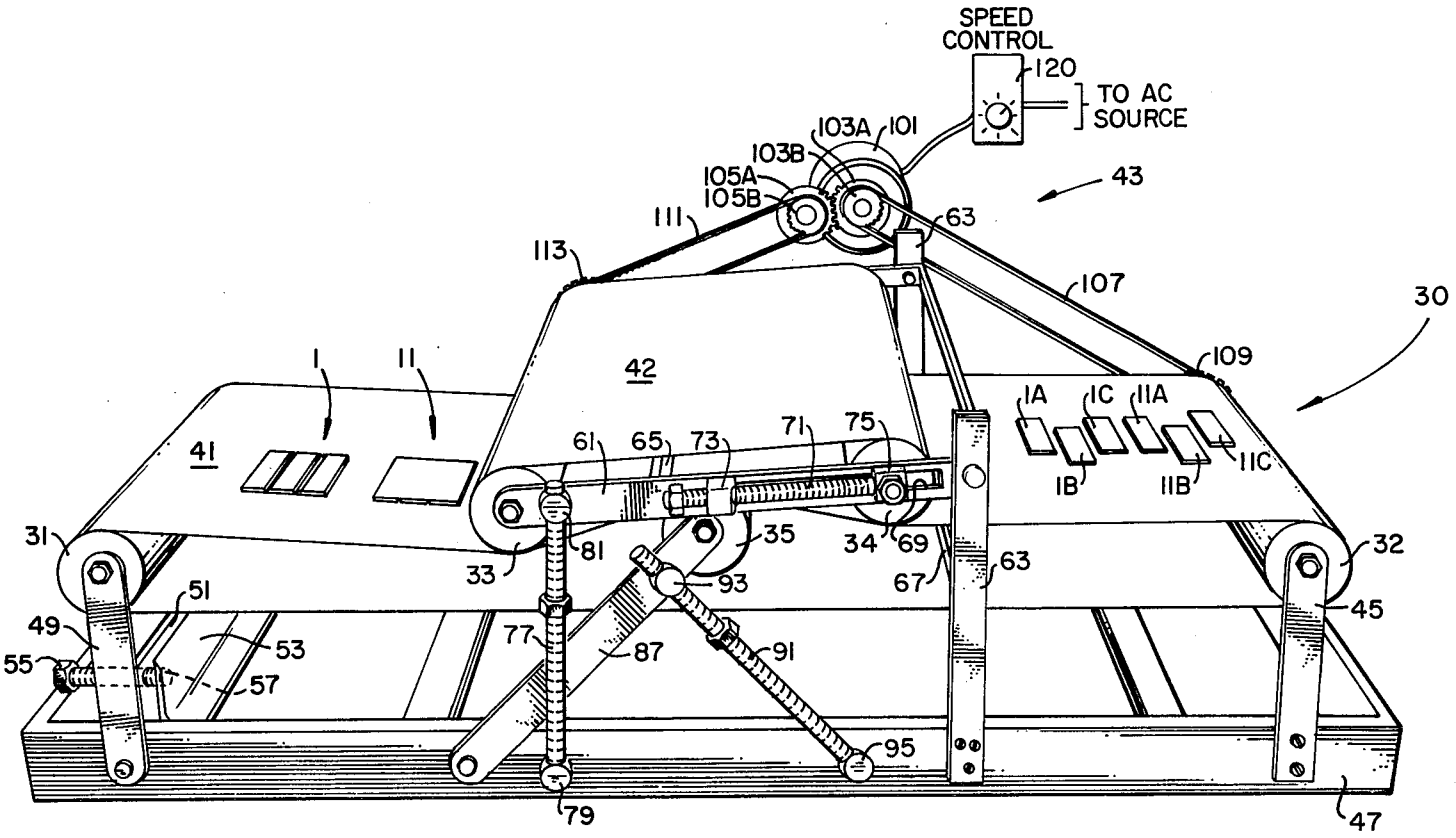
FIG. 6 is a perspective view of a machine 30 embodying this invention.

A machine 30 embodying this invention for automatically breaking both types of snapstrates 1 and 15 along kerfs thereon, with a very low scrap rate, is illustrated in FIG. 6. Both sides of the machine 30 are substantially the same. A simplified schematic representation of a side view of this machine is illustrated in FIG. 7.

Figure 7:
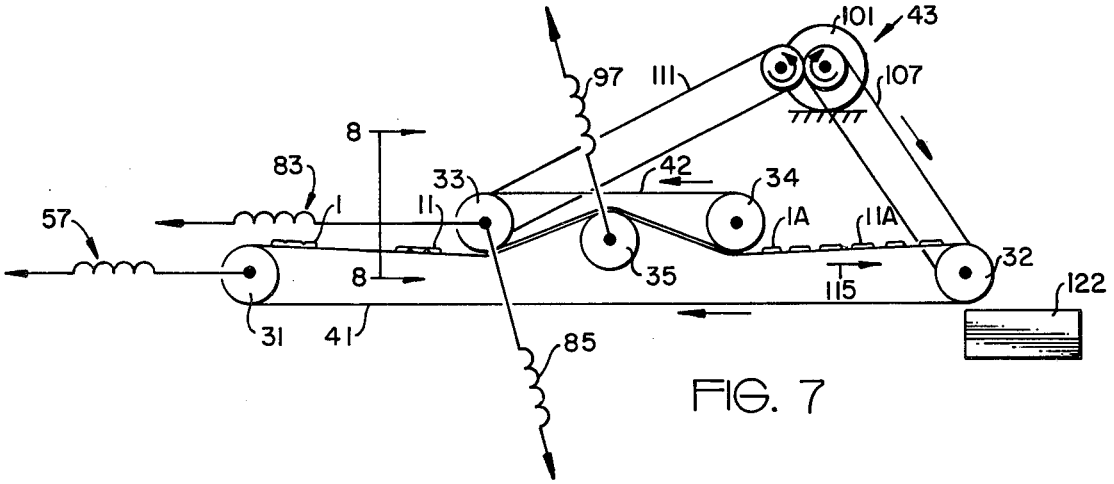
FIG. 7 is an elevation view of a schematic representation of the machine in FIG. 6.

The machine 30 generally comprises a first pair of rollers 31 and 32 supporting a first endless belt 41, a second pair of rollers 33 and 34 supporting a second endless belt 42, a fifth roller 35 pressing against the bottom of belt 41 for forcing belts 41 and 42 into contact over the lengths thereof between rollers 33 and 34, and drive means 43 for causing the belts to move from left-to-right in FIGS. 6 and 7. The lower roller 32 is rotatably supported at one end of arms 45 which are rigidly attached to a base plate or frame 47. The other lower roller 31 is rotatably supported at one end of arms 49 which are rotatably attached to frame 47 such as by shoulder screws. A bar 51 extends between and is rotatably attached to arms 49 for providing structural rigidity to this assembly. An angle-iron beam 53 is located behind the arms 49 and attached to the top of the frame 47. The position of roller 31 is moveable for varying the tension in belt 41. This movement of roller 31 is accomplished by rotating a pair of adjustment screws 55 which are threaded through holes in bar 51 and which have the ends thereof secured in swivel-shoe assemblies 56 that are attached to beam 53. The spring 57 in FIG. 7 illustrates that the position of roller 31 is adjustable in the direction indicated there to vary the tension on belt 41.

The upper rollers 33 and 34 associated with the second belt 42 are rotatably supported in arms 61 which are rotatably attached at one end thereof to arms 63 which are rigidly secured to the frame. The arms 61 may be connected together by a bar 65 extending between them for providing structural support. A member 67 may extend between the arms 63 for accomplishing a similar function. The position of roller 33 in arms 61 is fixed. The shaft supporting roller 34, however, is located in elongated slots 69 in arms 61 for adjusting the position of roller 34, and thus the tension in belt 42. This movement of roller 34 is provided for by adjustment screws 71 which are associated with threaded supports 73 and swivel-shoe assemblies 75 on shafts of roller 34 on each side of the machine. Adjustment of the vertical position of arms 61 and roller 33, and thus the angle and pressure with which belt 42 contacts belt 41 (as is described more fully hereinafter), is provided by adjustment screws 77, swivel-shoe assemblies 79, and threaded supports 81 on opposite sides of the machine. The springs 83 and 85 in FIG. 7 illustrate that the position of roller 33 is adjustable in the directions indicated there.

The fifth roller 35 is rotatably supported on one end of arms 87 which have the other ends thereof rotatably attached to the frame 47 such as by shoulder screws. The position of roller 35 is adjustable for varying the amount of pressure that it and the upper rollers exert on the belts between the latter, and thus the amount of curvature introduced in the belts adjacent these rollers. Adjustment of the vertical position of roller 35 is provided by adjustment screws 91, threaded supports 93, and swivel-shoe assemblies 95 on opposite sides of the machine. Alternatively, the lower ends of screws 91 may be located in support blocks which are rotatably secured to the frame and interconnected through a shaft which is connected to a ratchet assembly (not shown) for moving the support blocks, and thus the screws 91, arms 87 and roller 35. The spring 97 in FIG. 7 illustrates that the position of roller 35 is adjustable in the direction indicated there for varying the force it exerts on belts 41 and 42 and the curvatures it produces in them. Springs may also be connected between the frame and arms 49 and 87 to aid in moving rollers 31 and 35 as associated screws there are loosened.

The mechanism 43 for driving rollers 32 and 33, for example, for moving belts 41 and 42 clockwise and counterclockwise in FIGS. 6 and 7 is conventional. It may comprise a motor 101 supporting a sprocket 103A driving a driven sprocket 105A that is mounted on a support shaft. Associated driven sprockets 103B and 105B have chains 107 and 111 thereon connected to sprockets 109 and 111 on rollers 32 and 33, respectively, to connect a positive drive to each of the belts 41 and 42. The diameters of the various sprockets and rollers are selected so that the two belts move at the same linear rate.

In a machine 30 for operating on flat snapstrates 1 and 11, the rollers are cylindrical, of the same diameter, and positioned with their axes parallel to each other. Snapstrates 1 and 11 are set on the left-side of belt 41 with kerfs thereon generally parallel to the axes of the rollers. Movement of the belts first carries the snapstrates between roller 33 and belt 41 and then between the belts as they pass roller 35 while moving from left-to-right in the figures.

Reference to FIG. 7 reveals that the rollers 31, 33, and 35 cooperate to cause the top of belt 41 to be concave shaped as it passes roller 33 so as to cause a downward flexure force along the surface of a snapstrate passed between this roller 33 and belt 41. Conversely, the rollers 33, 34 and 35 cooperate to cause the facing surfaces of belts 41 and 42 to be convex shaped and concave shaped, respectively, adjacent roller 35. This causes an upward flexure along the surface of a snapstrate passed between the belts 41 and 42 adjacent roller 35. If the tensions produced on the belts by spring mechanisms 57 and 83 are small, and if forces exerted by the spring mechanisms 85 and 97 and associated rollers 33 and 35 on the belts is also small, then snapstrates 1 and 11 on belt 41 will move between the belts and past rollers 33 and 35 without being broken. As the spring mechanisms are adjusted to exert more force on the rollers to increase the tensions in the belts, the rollers and belts exert higher flexure forces on snapstrates moving from left-to-right in FIG. 7. Increasing the pressure exerted on roller 35 by spring mechanism 97 also increases the curvature in the belts.

In accordance with this invention, the tension in the belts and pressure produced on them by rollers 33, 34 and 35 are adjusted empirically to produce curvatures in the belts at rollers 33 and 35 which exert flexure forces on a snapstrate 1 that are generally sufficient to fracture a snapstrate facing in the right direction, along a kerf parallel to the axes of the rollers, but which are generally less than that required to break such a snapstrate facing in the wrong direction. The flexure force exerted by roller 33 and belt 41 then fractures snapstrate 11 along the downward facing kerfs 12 and 13. The flexure force exerted by this roller 33 and belt 41 is not sufficient and is in the wrong direction, however, to fracture the next snapstrate 1 along upward facing kerfs 3 and 4 there. The roller 33 therefore has no effect on the snapstrate 1. The belts at roller 35 have no effect on separated substrates of snapstrate 11. As snapstrate 1 passes between belts 41 and 42 adjacent roller 35, however, the flexure force exerted on this snapstrate 1 here fractures it along the upward facing kerfs 3 and 4. The separated substrates on the right side of belt 41 pass over the roller 32 and are deposited in a box 122 (see FIG. 7).

Figure 8:
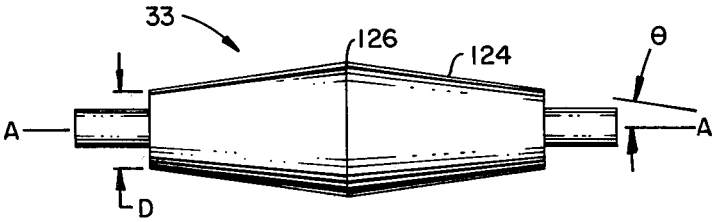
FIG. 8 is a front elevation view of roller 33 taken in the direction of the arrows 8—8 in FIG. 7.

In an alternate embodiment of this invention for separating a snapstrate 15 into individual substrates, the periphery of each of the rollers 33 and 35 is tapered from the center 126 thereof toward the outside edges as is shown in the front elevation view of roller 33 in FIG. 8. Alternatively, all of the rollers may be tapered in this manner. The straight lines such as line 124 on the periphery of roller 33 intersect the axis of rotation A—A thereof at an acute angle $\theta$. This shape of roller 33 causes it to exert a downward force on the center of belt 41. Conversely, this shape of the next roller 35 bows the centers of the belts 41 and 42 upward. The lower belt 41 is this machine preferably has a straight line extending down the center of it which is aligned with the center points 126 on rollers 33 and 35. In this manner, a snapstrate 15 having downward facing kerfs, and the kerf 18 aligned with the points 126 on the rollers, and kerfs 16 and 17 parallel to the axes of the rollers, are fractured along each of the kerfs as it passes between roller 33 and belt 41. Conversely, such a member with upward facing kerfs is fractured in a similar manner as it passes between the belts adjacent roller 35.

A machine 30 embodying this invention was built and satisfactorily operated for accommodating snapstrates 1 and 11 typically measuring from 1.5 inches×2.4 inches×0.025 inch to 2.0 inches×3.0 inches×0.025 inch. It also accommodated such snapstrates including only a pair of connected substrates. The same machine was used with snapstrates 15 typically measuring 2.0 inches×2.4 inches×0.025 inch. In this machine, the spacing between rollers 31 and 32 was typically 35 inches; the spacing between rollers 33 and 34 was typically 10.5 inches; and the spacings between roller 31 and the rollers 33 and 35 were typically 9.5 and 14 inches, respectively. All the rollers were 6 inches wide and had a diameter "D" of 3.5 inches, the two rollers 33 and 35 being tapered from the center thereof at an angle $\theta=2°$. The belts were both approximately 6 inches wide, 0.125 inch thick, and made of tightly woven canvas belting so that they were relatively pliable. The tension on the belts and pressure on the rollers may be adjusted for each size and shape snapstrate. This machine operated satisfactorily on snapstrates with scrap rates which may be less than 2%. The relative positions and diameters of the rollers obviously have an effect on the amount of flexure force exerted on a snapstrate in the machine and what size snapstrates may be accommodated by it without breaking a large number of them incorrectly. In practice, these factors are determined emperically.

Although this invention is described in relation to preferred embodiments thereof, variations and modifications thereof will be apparent to those skilled in the art without departing from the spirit of this invention. By way of example, it is only necessary to employ three rollers 31, 32 and 33 and a single belt 41 to separate snapstrates of the type illustrated in FIGS. 1–4. If a snapstrate is not fractured in the desired manner as it moves past the upper roller 33, it is only necessary to turn it over and again pass it between roller 33 and belt 41 to separate it into substrates. Also, such a machine could be operated without connecting a direct drive to the upper roller 33. Further, in a machine for separating a snapstrate into individual substrates in a single pass through the machine, the periphery of the rollers 33 and 35 in a longitudinal section view thereof may be lines which are either convex or concave. Also, the periphery of rollers 33 and 35 (and other of the rollers) may be tapered from points other than the center thereof. Additionally, snapstrates may have kerfs on both sides of the ceramic member. Further, different methods of driving the rollers, providing tension on the belts, and causing roller 35 to exert a force on the belts between the upper rollers 33 and 34, may be employed. The scope of this invention is therefore defined by the attached claims rather than from the aforementioned detailed description of preferred embodiments thereof.

What is claimed is:

1. Apparatus for separating a snapstrate into substrates, where the snapstrate is a matrix of thick film dielectric substrates formed on a common dielectric member that is divided into adjacent substrates by at least one kerf, comprising:

a first roller;

a first endless belt;

second and third rollers supporting said first belt for rotation with a first selected amount of tension in it;

first means causing rotation of said first belt;

a fourth roller;

a second endless belt;

second means supporting said first and fourth rollers above said first belt for rotation about their axes which are parallel to axes of other rollers and are generally perpendicular to the direction of rotation of said belts, and supporting said second belt for rotation around said first and fourth rollers with a second selected amount of tension in it;

a fifth roller supported for rotation about its axis which is parallel to the axes of other rollers, said fifth roller being located between top and bottom portions of said first belt and between said second and third rollers at a position that is between said first and fourth rollers; and third means causing said first and fifth rollers to force said first and second belts into pressure contact with each other at points between said second and fifth and said first and fourth rollers, respectively, so that said first and second belts are contiguous over a suspended length of the latter; the tension in said belts and diameters of said first and fifth rollers cooperating for producing smooth curves in said first and second belts which open in opposite directions where they pass under and over said first and fifth rollers, respectively, for flexing snapstrates (having kerfs generally parallel to the longitudinal axes of rollers and facing toward and away from the top of said first belt) sufficiently in a direction for fracturing and separating them along such kerfs, but not sufficiently to fracture such snapstrates with such kerfs facing in the opposite direction, as they move past said first and fifth rollers, respectively.

2. Apparatus according to claim 1 wherein said first means causes synchronous rotation of one of said second and third rollers and of one of said first and fourth rollers for causing a positive drive to move said first and second belts in opposite directions.

3. Apparatus according to claim 2 wherein said third means comprises means for adjusting the pressure with which said fifth roller forces said first belt against said second belt at a point between said first and fourth rollers.

4. Apparatus according to claim 3 wherein said rollers are cylindrical.

5. Apparatus according to claim 1 wherein the circumference of at least each of said first and fifth rollers, in a vertical section in a first plane including its longitudinal axis, is tapered from interior points thereon toward its edges for flexing snapstrates on the first belt with kerfs facing toward and away from said first belt, some kerfs being generally orthogonal to the axes of said rollers and being generally in a second plane including the interior points and orthogonal to the first plane, in a direction for separating them along these some kerfs as they move past said first and fifth rollers, respectively.

6. Apparatus according to claim 5 wherein the circumference of all of said rollers are tapered.

7. Apparatus according to claim 5 wherein said third means comprises means for adjusting the position of said first roller whereby the amount of pressure with which it forces said second belt into contact with said first belt is adjustable.

8. Apparatus according to claim 7 including fourth means for adjusting the position of one of said second and third rollers for adjusting the amount of tension in said first belt.

* * * * *